US006588480B2

(12) United States Patent
Anderson

(10) Patent No.: US 6,588,480 B2
(45) Date of Patent: Jul. 8, 2003

(54) COUNTER WRAP CORD DRIVE

(75) Inventor: Richard N. Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/907,429

(22) Filed: Jul. 17, 2001

(65) Prior Publication Data

US 2002/0050539 A1 May 2, 2002

Related U.S. Application Data

(60) Provisional application No. 60/219,926, filed on Jul. 21, 2000.

(51) Int. Cl.[7] ..... E06B 9/322

(52) U.S. Cl. ..... 160/170; 160/173 R; 160/178.1 R

(58) Field of Search ..... 160/170, 171, 160/168.1 R, 173 R, 176.1 R, 177 R, 178.1 R; 74/89.22; 242/613.1, 407

(56) References Cited

U.S. PATENT DOCUMENTS

| | | | | |
|---|---|---|---|---|
| 1,799,137 | A | | 3/1931 | Simpson |
| 2,227,211 | A | | 12/1940 | Balthasar |
| 2,250,106 | A | | 7/1941 | Lorentzen |
| 2,334,132 | A | * | 11/1943 | Sherwood |
| 2,580,252 | A | * | 12/1951 | Stuber et al. |
| 2,851,098 | A | * | 9/1958 | Rosenbaum |
| 5,328,113 | A | | 7/1994 | de Chevron Villette et al. |
| 5,725,040 | A | | 3/1998 | Domel |
| 6,076,587 | A | | 6/2000 | Pastor |
| 6,079,471 | A | | 6/2000 | Kuhar |
| 6,223,802 | B1 | * | 5/2001 | Colson |

FOREIGN PATENT DOCUMENTS

| | | |
|---|---|---|
| CH | 581 257 | 9/1976 |
| CH | 672 658 | 12/1989 |
| DE | 298 07 940 U1 | 10/1998 |
| GB | 13798 | of 1893 |
| GB | 923205 | 4/1963 |
| GB | 931344 | 7/1963 |
| GB | 1132985 | * 11/1968 |
| GB | 2163202 | 1/1988 |
| JP | 11270253 | 10/1999 |
| NZ | 154 363 | 9/1969 |

* cited by examiner

*Primary Examiner*—Blair M. Johnson
(74) *Attorney, Agent, or Firm*—Camoriano & Associates; Theresa F. Camoriano; Guillermo E. Camoriano

(57) ABSTRACT

A cord drive has two cords mounted on two spools. Pulling the first cord unwraps the first cord from the first spool, causes a drive shaft to rotate in one direction, and causes the second cord to wrap onto the second spool. Pulling the second cord unwraps the second cord from the second spool, causes the drive shaft to rotate in the opposite direction, and causes the first cord to wrap onto the first spool.

42 Claims, 11 Drawing Sheets

COUNTER WRAP CORD DRIVE

This application claims priority from U.S. Provisional Application S. No. 60/219,926, filed Jul. 21, 2000.

BACKGROUND OF THE INVENTION

The present invention relates to a cord drive for producing rotary motion. In the embodiments shown here, the cord drive is used for raising and lowering coverings for architectural openings such as Venetian blinds, pleated shades, and other blinds and shades. This cord drive may also be used on vertical blinds and other mechanical devices requiring rotary motion.

Typically, a blind transport system will have a top head rail which both supports the blind and hides the mechanisms used to raise and lower or open and close the blind. Such a blind system is described in U.S. patent application Ser. No. 09/528,951, filed Mar. 20, 2000, which is hereby incorporated by reference. The raising and lowering is done by a lift cord attached to the bottom rail (or bottom slat). The opening and closing of the blind is typically accomplished with ladder tapes (and/or tilt cables) which run along the front and back of the stack of slats. The lift cords (in contrast to the tilt cables) may either run along the front and back of the stack of slats or they may run through slits in the middle of the slats, and are connected to the bottom rail.

A wide variety of drive mechanisms is known for raising and lowering blinds and for tilting the slats. A cord drive to raise or lower the blind is very handy. It does not require a source of electrical power, and the cord may be placed where it is readily accessible, getting around any obstacles.

In prior art cord drives used for blinds, it is typical for the same cord to be used to drive the lift action and to extend through the slats and fasten to the bottom slat (or bottom rail) to lift the blind.

Known cord drives have some drawbacks. The cords in a cord drive, for instance, may be such that they are either hard to reach when the cord is way up (and the blind is in the fully lowered position), or the cord may drag on the floor when the blind is in the fully raised position. Also, for heavy blinds, a large force may be required on the cord in order to lift the blind.

SUMMARY OF THE INVENTION

The present invention provides a cord drive which has the advantages of prior art cord drives, plus it eliminates many of the problems of prior art cord drives. One preferred embodiment of the present invention provides a cord drive which does not require the drive cord to travel as far as the lift cord. It also permits the use of a drive cord loop, which always has the same exposed length regardless of the position or length of the blind.

Note that, for the purposes of this description, we will hereafter refer to two drive cords, each having one end mounted on the cord drive. However, it should be understood that the language referring to two drive cords includes the situation in which the two drive cords are connected together to form a loop so that they are, in effect, a single cord having one end mounted on each spool of the cord drive.

In the present invention, the drive cord in the cord drive is a totally different cord from the lift cord which attaches to the bottom rail.

An objective of the present invention is to have a simple wind up spool system with a minimum of moving parts, which will consistently and reliably wind and unwind the drive cords without jamming or over-wrapping, and with the ends of the drive cords exiting the cord drive always at the same location instead of moving along the length of the wind up spool.

To accomplish these goals, a preferred embodiment of the cord drive includes two spools which rotate as a single piece. The drive cords are counter-wrapped onto the spools such that, as both spools rotate in the same direction, one cord is unwinding from its respective spool, while the second cord is winding onto its spool. Finally, the spools have a slight taper at the inlet end, where the drive cords are first wrapped onto the spools, and the cord drive includes a cover which not only accurately positions the cords onto the tapered section of the spools: it also has a clearance of less than twice the diameter of the drive cord between the outer tapered surface of the spool and the inner surface of the cover. Thus, as the cord is placed onto the tapered surface of the spool, the drive cord wraps are displaced axially along the length of the spool and down the tapered surface of the spool, and the clearance will not allow an over-wrap condition to occur. The cover may also provide support for the spools; it may guide the drive cords so they exit the cord drive at the same location all the time; and it may also provide a mounting mechanism to mount the cord drive to the head rail.

When the cord drive is used for a blind, the drive spools may be connected to the rest of the blind mechanism by means of a lift rod or drive shaft. In fact, the lift rod may be the mechanism linking the two spools together so that they rotate as a single unit, as is the case in some preferred embodiments. Then, as a drive cord end is pulled in the cord drive mechanism, it unwinds from a first spool and makes this first spool rotate. The rotation of this first spool causes the lift rod to rotate which causes a second spool to rotate, thus causing the other drive cord to counter-wrap onto this second spool. The rotation of the lift rod may also cause a lift station to rotate, winding or unwinding the lift cord to raise or lower the blind, depending on the direction of rotation.

While the present invention is shown being used in a typical horizontal Venetian blind, it should be obvious to those skilled in the art that this cord drive may be used in any number of different types of mechanical drives.

DESCRIPTION OF THE PREFERRED EMBODIMENTS

Figure 1:
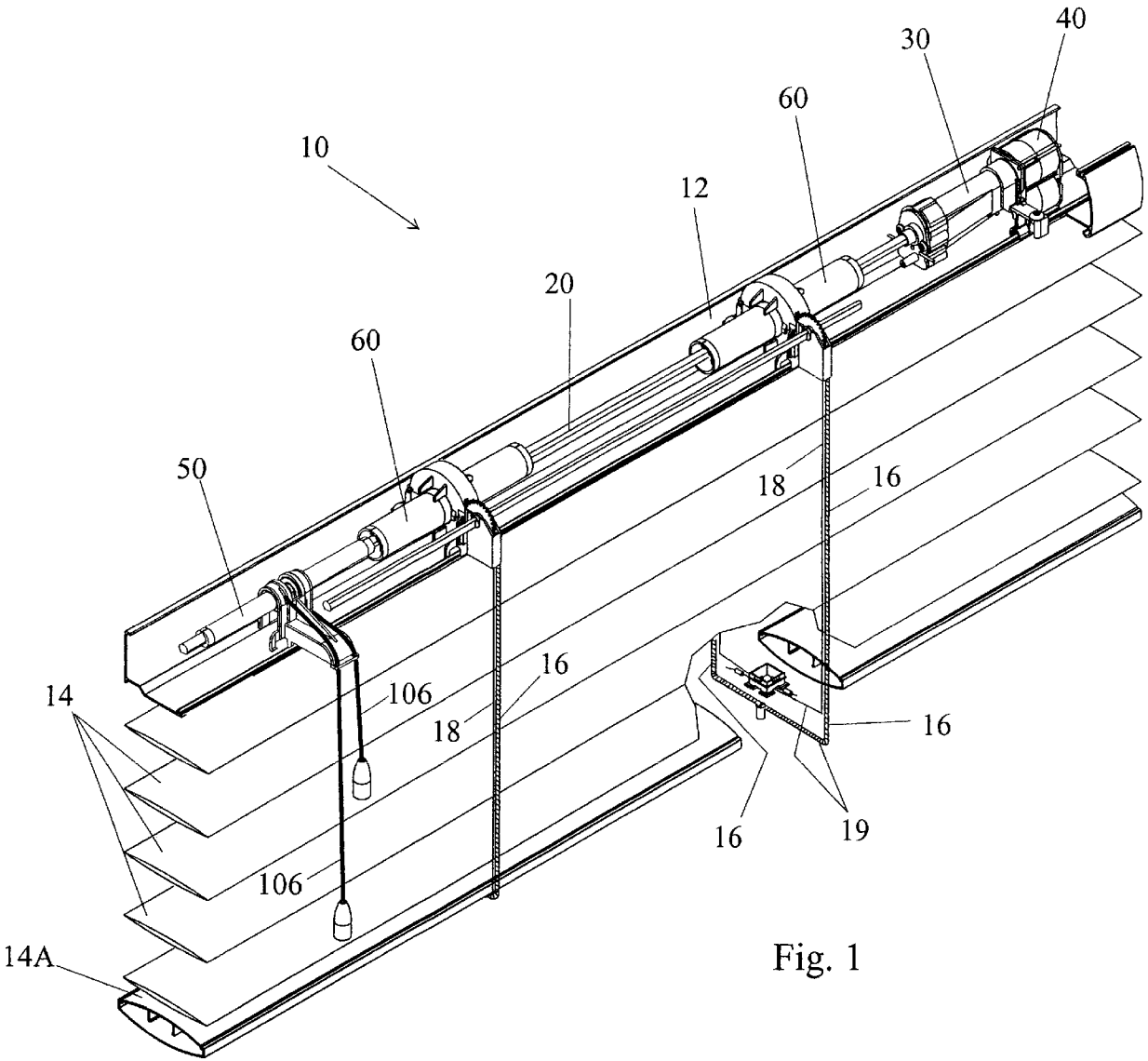
FIG. 1 is a partially broken away perspective view of a blind incorporating a cord drive made in accordance with the present invention.

Referring now to FIG. 1, the blind 10 includes a head rail 12, and a plurality of slats 14 suspended from the head rail 12 by means of tilt cables 18 and the associated cross cords 19, which together comprise the ladder tapes, as is well known in the art. Front and back lift cords 16 extend through the head rail and along the front and back of the stack of the slats 14, and are fastened at the bottom of the bottom slat (or bottom rail) 14A, which is heavier than the other slats 14. Inside the head rail 12 are a counter wrap cord drive 50, two lift and tilt modules 60, a transmission 30, which is close coupled to a spring motor 40, and a lift rod or drive shaft 20, which interconnects the counter wrap cord drive 50 with the lift modules 60 and the transmission 30.

Figure 6:
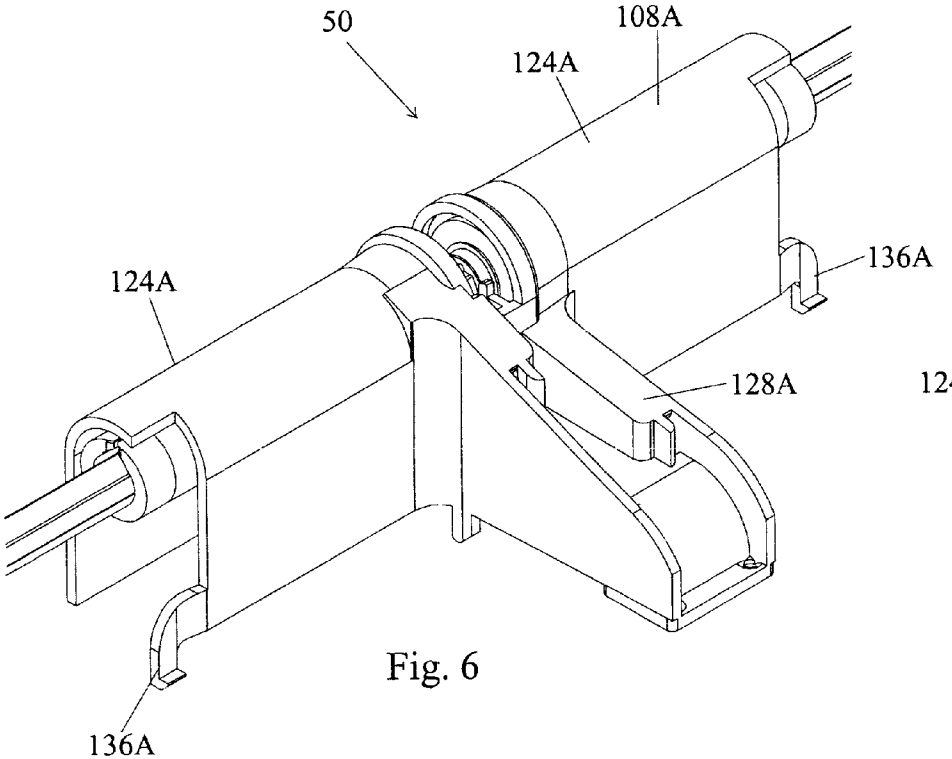
FIG. 6 is a perspective view of a third embodiment of a cord drive made in accordance with the present invention.
Figure 8:
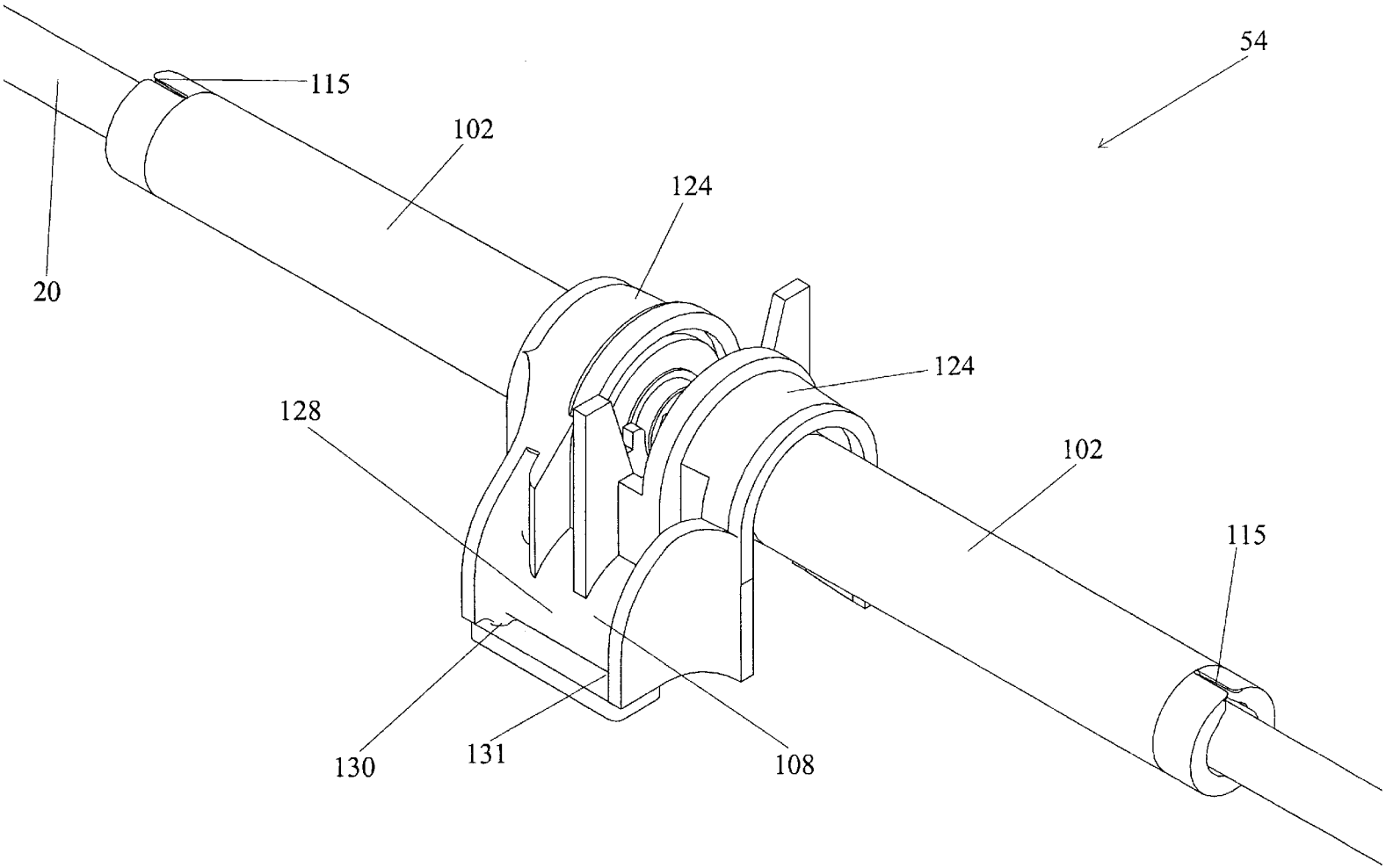
FIG. 8 is a perspective view of a fourth embodiment of a cord drive made in accordance with the present invention but with the cords removed for clarity.
Figure 9:
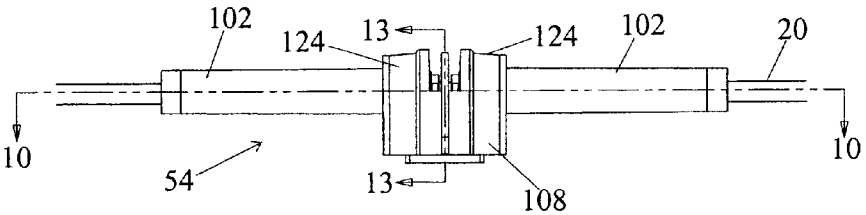
FIG. 9 is a rear view of the cord drive of FIG. 8.

FIG. 6 shows a perspective view of the cord drive 50 of FIG. 1. This cord drive 50 is identical to the cord drive 54 of FIGS. 8–14, which is described below in detail, except that this cord drive 50 has a longer cover 108, both radially and axially, than the cover 108 of the cord drive 54.

Referring now to FIGS. 8–14, the cord drive 54 includes left and right spools 102, left and right drive cords 106 (See FIGS. 1, 10, 11, 12, and 14), a lift rod or drive shaft 20, and a cover 108. The two spools 102 are identical but are arranged in mirror image positions relative to each other, with the inlet portions of the two spools 102 adjacent each other. As will be seen in other embodiments described later, they may be made as a single piece. The spools 102 are hollow, substantially cylindrical members with an inside surface 110 which has a non-circular profile (See FIGS. 12–14) that closely matches the external profile of the lift rod or drive shaft 20 so that the spools 102 rotate with the drive shaft 20.

Figure 15:
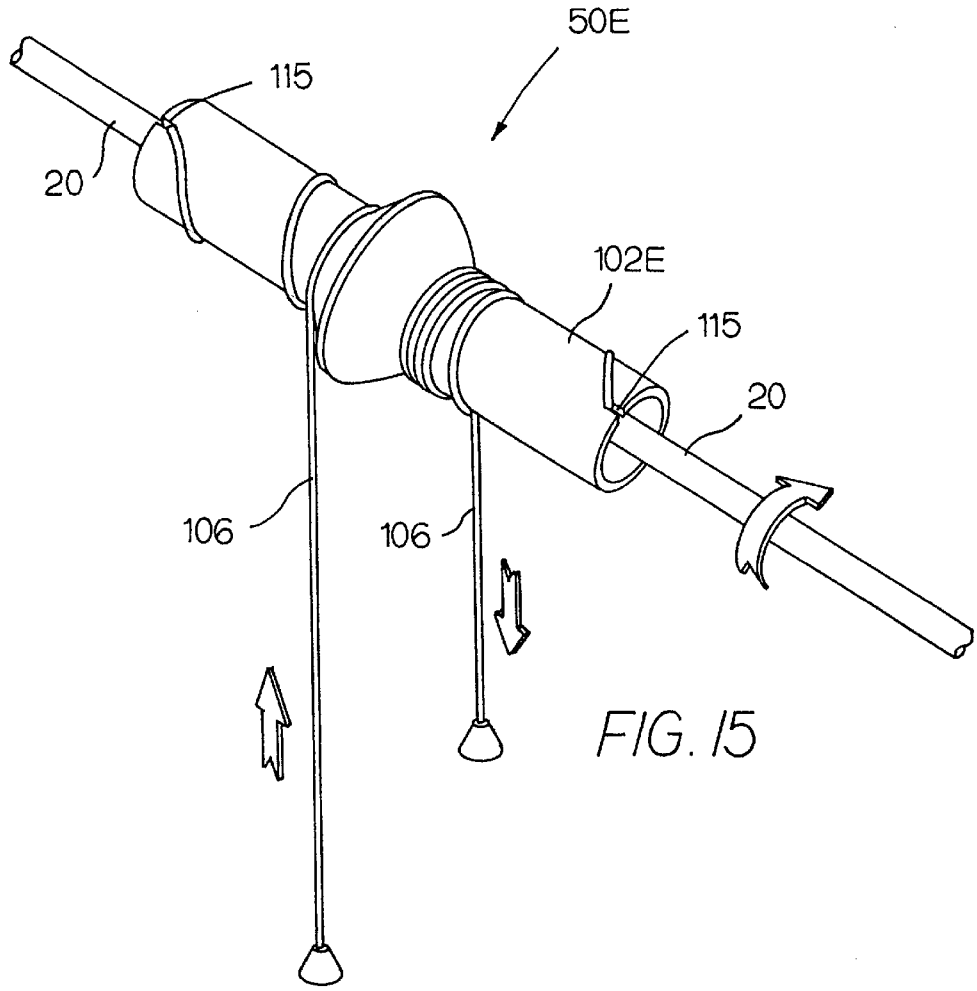
FIG. 15 is a schematic, broken away, perspective view of a fifth embodiment of a cord drive made in accordance with the present invention, where the cover has been removed for clarity.
Figure 16:
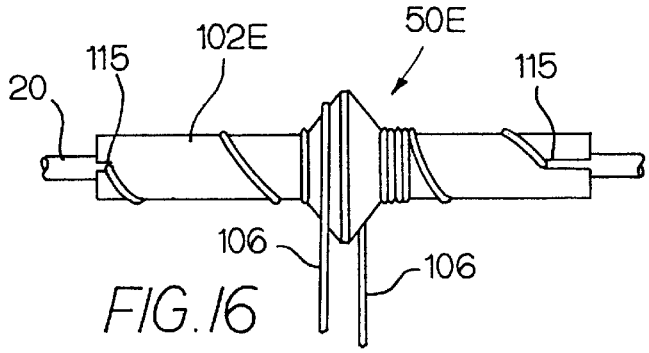
FIG. 16 is a front view of the cord drive of FIG. 15.

The spools 102 have a tapered outside surface 112, which tapers from its maximum diameter at the inlet end of the spool (near the center of the cord drive unit 54) to its minimum diameter at the outer end of the spool. The maximum diameter inlet end terminates in a flange 114, and the minimum diameter end has a short slit 115 (See FIGS. 3A, 8, 15, and 16) used to secure one end of the respective drive cord 106 to its spool 102. FIGS. 15 and 16 are schematic views showing spools similar to the spools 102 of FIGS. 8–14, but clearly showing the cords wrapped onto the spools. In order to fasten the drive cord 106 to the spool 102, an enlargement, such as a knot (not shown), is tied to an end of the drive cord 106. This knot is slid behind the slit 115 at the end of the spool 102, and thus the drive cord 106 is quickly and easily secured to the end of the spool 102. Beyond the flange 114 of the spool 102 is a short, hollow, stub shaft 116 having a smaller outside diameter than the flange 114. (See FIGS. 10 and 13). The stub shaft 116 supports one end of the spool 102, as will be explained later.

Looking more closely at the tapered surface 112 of the spool 102 (See FIG. 3A), this tapered surface 112 has four distinct segments 112A, 112B, 112C, and 112D. Segment 112A is closest to the flange 114 and receives a shoulder 122, as will be explained later. It is the shortest segment and may be either cylindrical or it may have just enough taper as is required for mold release in the fabrication process. The second segment 112B is also short (though longer than segment 112A) and has the steepest taper of the four segments 112A, 112B, 112C, 112D. The second segment 112B is the inlet portion of the spool 102. The taper on this segment 112B should be selected so that it is neither too steep nor too shallow. If the taper is too steep, the cord 106 will slide down to the minimum diameter in one wrap, which is undesirable. The last wrap of cord 106 laid on the tapered surface 112B carries the largest part of the load (in this instance, the weight of the stack of blinds being raised or lowered). Thus, it is desirable that this last wrap of cord 106 rest on the tapered surface 112B so that, as the next wrap of cord 106 is also laid on the tapered surface 112B, the pre-existing wrap of cord 106 will no longer be carrying the largest part of the load (since the latest wrap of cord 106 will now be the last wrap of cord 106 and it will now have absorbed the largest part of the load). Thus, the preexisting wrap of cord 106 is no longer carrying the brunt of the load and it will be easily displaced toward the smaller diameter. If, on the other hand, the taper of segment 112B is too shallow, this pre-existing wrap of cord 106 will tend not to readily slide down to the smaller diameter.

The third segment 112C is the longest segment and is used primarily for storage of the cord 106. This segment 112C may be referred to as the storage portion of the spool. The amount of taper present in this segment preferably is only that required for easy molding of the component, and this segment could be cylindrical (no taper at all) because, at this point, there is virtually no compression between the cord wraps and the cylinder surface, which allows the cord draft to be easily displaced toward the outer end (the end opposite the flanged 114). The final segment 112D begins with the base of the slot 115 and the amount of taper present in this segment 112D is unimportant and in fact it is typically cylindrical, because no cord 106 wraps occur in this area. So, the inlet portion 112B of the spool 102 has a substantial taper, with its diameter decreasing in the direction of the storage portion 112C. The storage portion 112C has substantially less taper than the inlet portion 112B, with the storage portion 112C having little or no taper.

The cover 108 serves several functions. First, it serves as a support for the spool 102 (together with the lift rod 20). It also serves as a mounting mechanism to mount the cord drive 54 onto the head rail 12. It also serves as a mechanism to guide the drive cords 106 onto the inlet portions of the spools 102, as well as off the spools 102 and through the head rail 12.

The cover 108 is a one-piece construction having left and right portions, which are mirror images of each other. Each portion of the cover 108 is designed to fit over the flange 114 end of one of the spools 102 in such a manner so as to lock the flange 114 in position against axial displacement while allowing free rotation of the spool 102. The cover 108 includes two inner projecting surfaces 118 (See FIGS. 10 and 13), each of which serves as an axial stop preventing the flange 114 of its respective spool 102 from moving axially inwardly, toward the center of the drive unit 54. At the same time, a semi-circular profile 120 on these inner projecting surfaces 118 provides a bearing surface to support the stub shaft 116 of its respective spool 102. Two outer shoulders 122 (See FIG. 10) project inwardly on the inside surface of the cover 108. Each of these shoulders 122 acts as a second axial stop on the other side of the flange 114 of its respective spool 102, preventing the spool 102 from moving axially outwardly, away from the center of the drive unit 54. Thus, the flange 114 of each spool 102 is effectively trapped between one of the outer shoulders 122 and one of the projecting surfaces 118 of the cover 108, thus fixing the axial location of the spool 102 relative to the cover 108. The cover 108 also has two short hoods 124. Each hood 124 provides a clearance of less than twice the diameter of the drive cord 106 between the tapered outer surface 112 of the spool 102 and the inner surface of the hood 124, which prevents the cord 106 from overwrapping.

Figure 10:
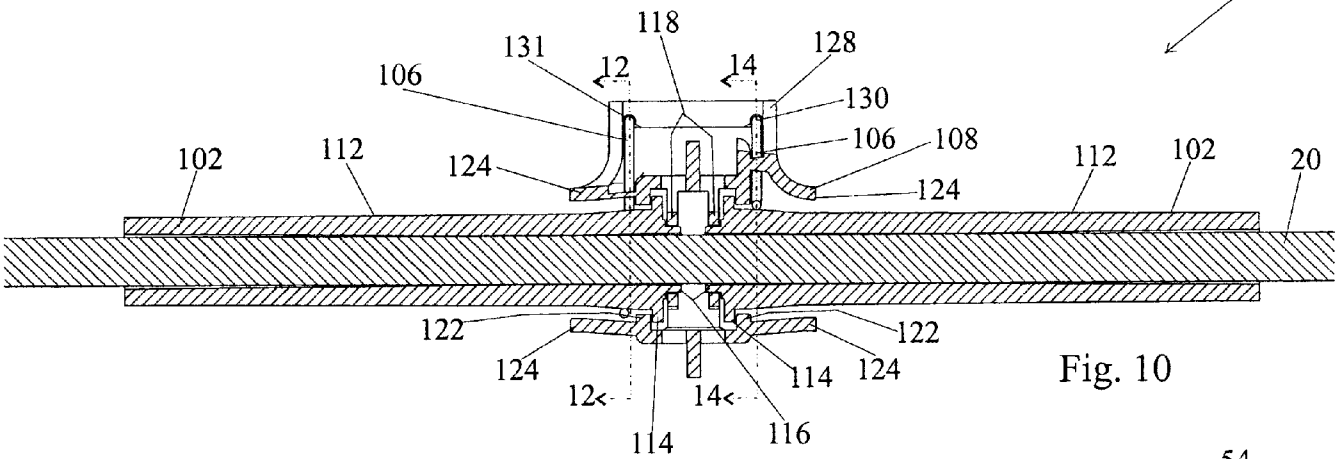
FIG. 10 is a sectional view along line 10—10 of FIG. 9, again with the cords removed from the spools for clarity.

As shown in FIG. 10, on the right side, the hood 124 also defines a substantially axially-oriented, convex curve on its inner surface, which helps guide the cord over a large radius as it is unwrapping from distant portions of the spool, in order to prevent the cord from having to make a sharp turn, and thereby minimizes friction.

The cover 108 has forward and rear upwardly projecting ears 126 and a forwardly projecting foot 128. The foot 128 fits inside an opening in the bottom of the head rail 12 to lock the cord drive 54 against horizontal movement relative to the head rail 12. The two ears 126 snap into the profile of the head rail 12 to lock the cord drive 54 against vertical movement relative to the head rail 12. The foot 128 has two holes 130, 131 through which the drive cords 106 pass in order to extend through the cord drive 54 and through the head rail 12. Thus, the drive cords 106 always exit the head rail 12 at the same place, through the two holes 130, 131 in the foot 128 of the cover 108 of the cord drive 54.

Figure 11:
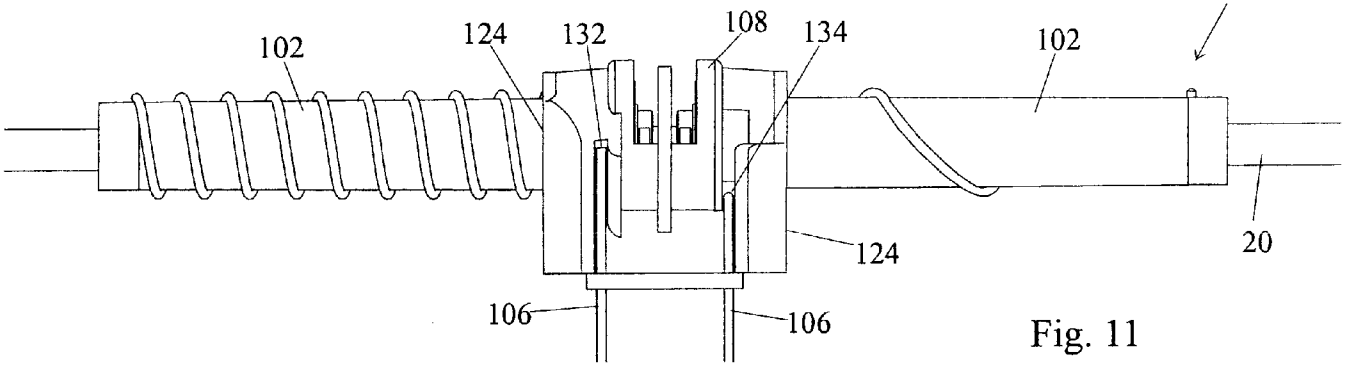
FIG. 11 is a front view of the cord drive of FIG. 8.
Figure 14:
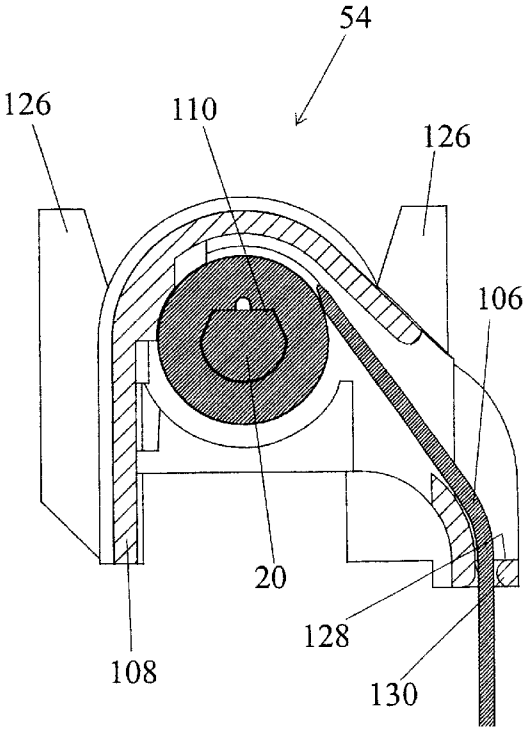
FIG. 14 is a sectional view along line 14—14 of FIG. 10, now showing the cords.
Figure 13:
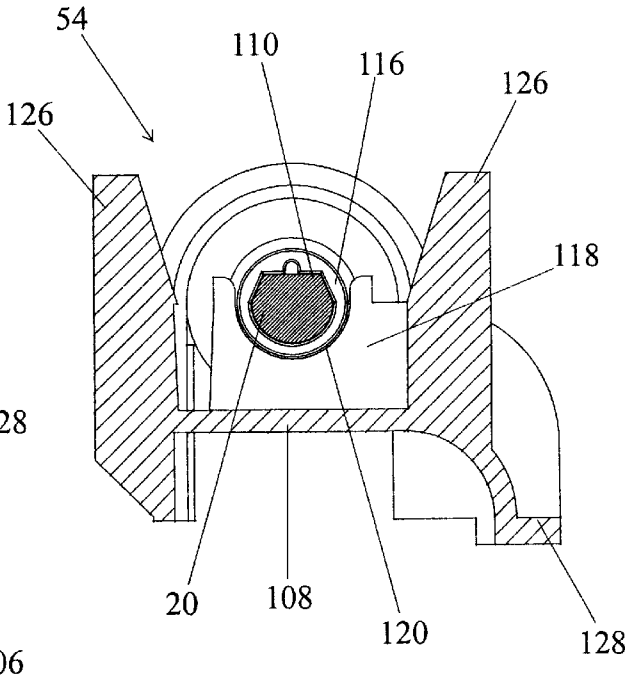
FIG. 13 is a sectional view along line 13—13 of FIG. 9, again showing the cords.
Figure 12:
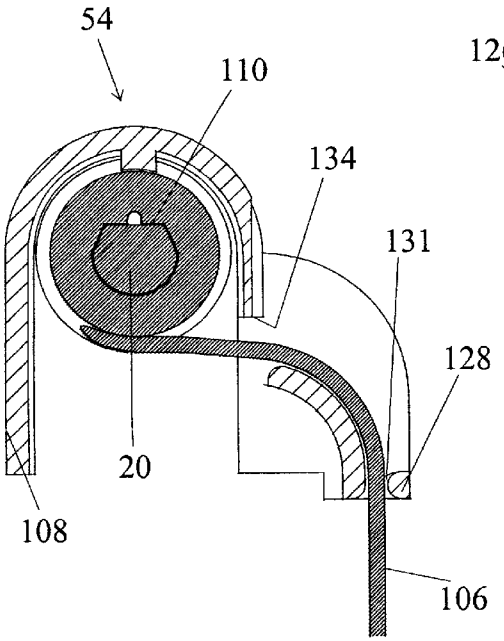
FIG. 12 is a sectional view along line 12—12 of FIG. 10, now showing the cords.

The cover 108 also has two additional holes 132, 134 (See FIG. 11). One hole 132 is at a height which is above the axial centerline of the cord drive 54 and is used to guide one drive cord 106 as it comes into the cord drive 54, to place the drive cord 106 on the tapered surface 112 of the first spool 102 such that, when the first spool 102 is turned counterclockwise (as seen from the vantage point of FIGS. 12 through 14), the first drive cord 106 winds onto the first spool 102. The second hole 134 is at a height which is below the axial centerline of the cord drive 54 and is used to guide the second drive cord 106 as it comes into the cord drive 54 to place it on the tapered surface 112 of the second spool 102 such that, when the spool 102 is turned counterclockwise (as seen from the vantage point of FIGS. 12 through 14), the second drive cord 106 unwinds from its spool 102. Thus, the two drive cords 106 are counter-wrapped onto their respective spools 102, meaning that, as the spools 102 rotate together, one drive cord 106 winds onto its respective spool as the other unwinds. In this embodiment, both spools 102 rotate together and in the same direction because they are both non-rotatably mounted on the same lift rod or drive shaft 20. Thus, the two spools 102 rotate as a single unit. As the first drive cord 106 is pulled, it unwinds from the first spool 102, causing the drive shaft 20 to rotate in a first direction, while the second drive cord 106 winds onto the second spool 102. The clearance of less than two times the cord diameter between the tapered surface 112 of the spool 102 and the hood 124 on the cover 108 prevents any over-wrap condition from occurring, and, as each successive wrap of drive cord 106 wraps onto its respective spool 102, it displaces the previous wrap of drive cord, shoving it sideways, axially along the tapered surface 112 of the spool 102. Similarly, as the second drive cord 106 is pulled, it unwinds from the second spool 102, causing the drive shaft 20 to rotate in the opposite direction, while the first drive cord 106 winds onto the first spool 102.

To assemble the cord drive 54, an end of a drive cord 106 is secured to its respective spool, via a knot or other enlargement, which is slid behind the slit 115. The drive cord 106 is threaded through a hole 132 or 134 in its respective cover 108 (going from the inside of the cover 108 to the outside of the cover 108), and it is further threaded through a hole 130 or 131 in the foot 128 of the cover 108. The spool 102 is then installed by pushing it up from under the cover 108 such that the stub shaft 116 pushes against the upwardly projecting surface 118, which has just enough flexibility in it to bend axially to allow the stub shaft 116 to slide past the surface 118, and thus allows the spool 102 to snap into place such that its flange 114 is trapped between the shoulder 122 and the projecting surface 118 of the cover 108, and the stub shaft 116 on the spool 102 is supported by the semi-circular profile 120 on the projecting surface 118. The spool 102 is then manually rotated in the appropriate direction until most of the drive cord 106 is wrapped onto its spool 102. This same procedure is followed for a second spool 102 and a second drive cord 106 except that, once the second spool 102 is snapped into place, its corresponding drive cord 106 is not wrapped onto it but is simply secured at the slit 115 and is threaded through its respective holes in the cover 108.

The assembled cord drive 54 is then mounted onto the head rail 12 by inserting the foot 128 in an opening (not shown) in the head rail 12 for that purpose. The cord drive 54 is then pushed down until the ears 126 snap into the profile of the head rail 12. Finally the lift rod or drive shaft 20 is inserted through the hollow inside surface 110 of both spools 102, and is extended through to connect to the lift modules 60 which are already connected to the lift cords 16 connected to the bottom rail 14A of the stack of slats in a manner which is well known in the art.

Now, as the end of the first, wrapped drive cord 106 is pulled, it unwraps from its spool 102, rotating the spool 102 as well as the lift rod 20. The second spool 102 also rotates with the lift rod 20, and in the same direction, wrapping the second drive cord 106 onto the second spool 102 as the first drive cord 106 is unwrapping from the first spool 102. Since the lift rod 20 is also connected to the lift module 60, the lift module 60 will also rotate and thus raise or lower the stack of slats.

At this point, the first drive cord 106 is unwrapped from the first spool 102, and the second drive cord 106 is wrapped on the second spool 102. As this second drive cord 106 in turn is pulled to unwrap form the second spool 102, it causes the lift rod or drive shaft 20 to rotate in the opposite direction, and it causes the first drive cord 106 to wrap onto the first spool 102. Thus, one drive cord 106 is always wrapping onto a spool 102 as the other drive cord 106 is being pulled and unwrapped. The cover 108 directs the incoming cord 106 onto the tapered inlet portion 112B of the outer surface 112 of the spool 102, where it is displaced down, axially along the taper toward the storage portion 112C of the spool 102 as a successive wrap is laid onto the tapered surface 112B of the spool 102. The hood 124, with its clearance of less than two drive cord diameters, ensures that no over-wrap condition occurs, so that the cord drive mechanism 54 will not jam or otherwise malfunction, since there is not enough clearance for two wraps of the drive cord 106 on top of each other.

Alternate Embodiments

Figure 7:
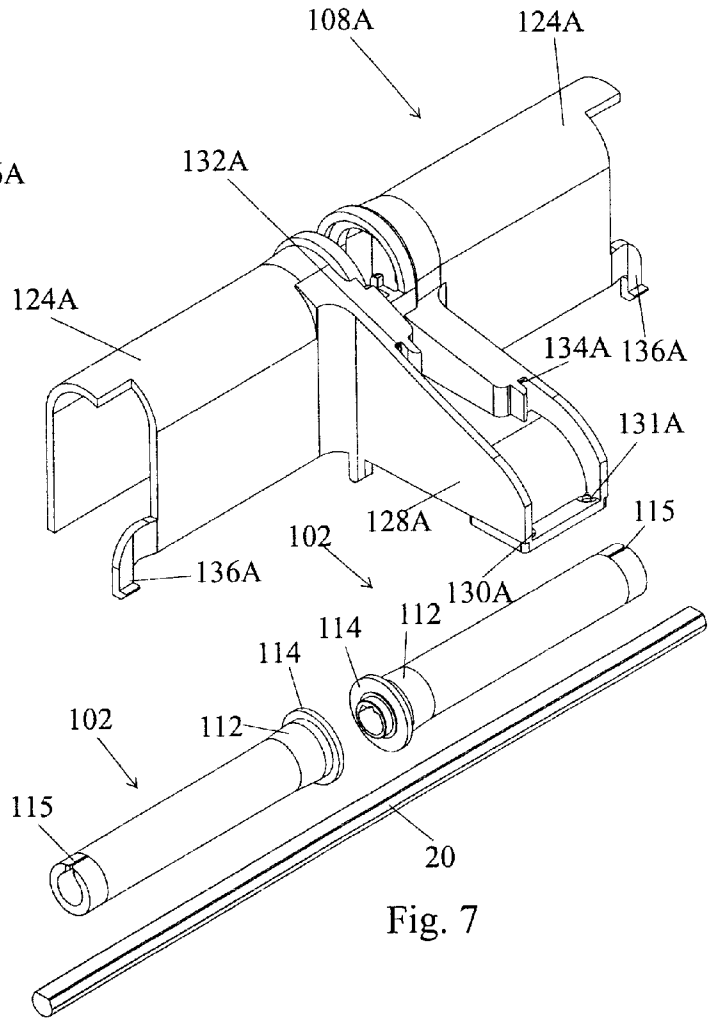
FIG. 7 is an exploded perspective view of the cord drive of FIG. 6.

What is described above with respect to FIGS. 8–14, is actually the fourth embodiment shown in the attached drawings. The first embodiment of a cord drive 50 is shown in FIGS. 1, 6, and 7. The only significant differences between the first embodiment of a cord drive 50, as shown in FIGS. 1, 6, and 7, and the fourth embodiment 54 described earlier is that the cover 108A of the first embodiment has longer hoods 124A extending axially as well as a longer foot 128A extending radially. The longer hoods 124A have hooks 136A used to secure the cord drive 50 to the head rail 12 instead of the ears 126 found in the fourth embodiment 54. The longer foot 128A is used when mounting the cord drive 50 onto a wide head rail 12 in order to ensure that the drive cords 106 exit through the head rail 12 at its front edge. These differences between the first and fourth embodiments of the present invention have no effect on the operation of the cord drive. In this and other embodiments to be described later, similar parts are given the same number followed by a "letter" to designate a difference. For instance, the cover in the fourth embodiment, shown in FIGS. 8–14, is item 108 while in the first embodiment, shown in FIGS. 1, 6 and 7, this cover is item 108A.

Figure 3:
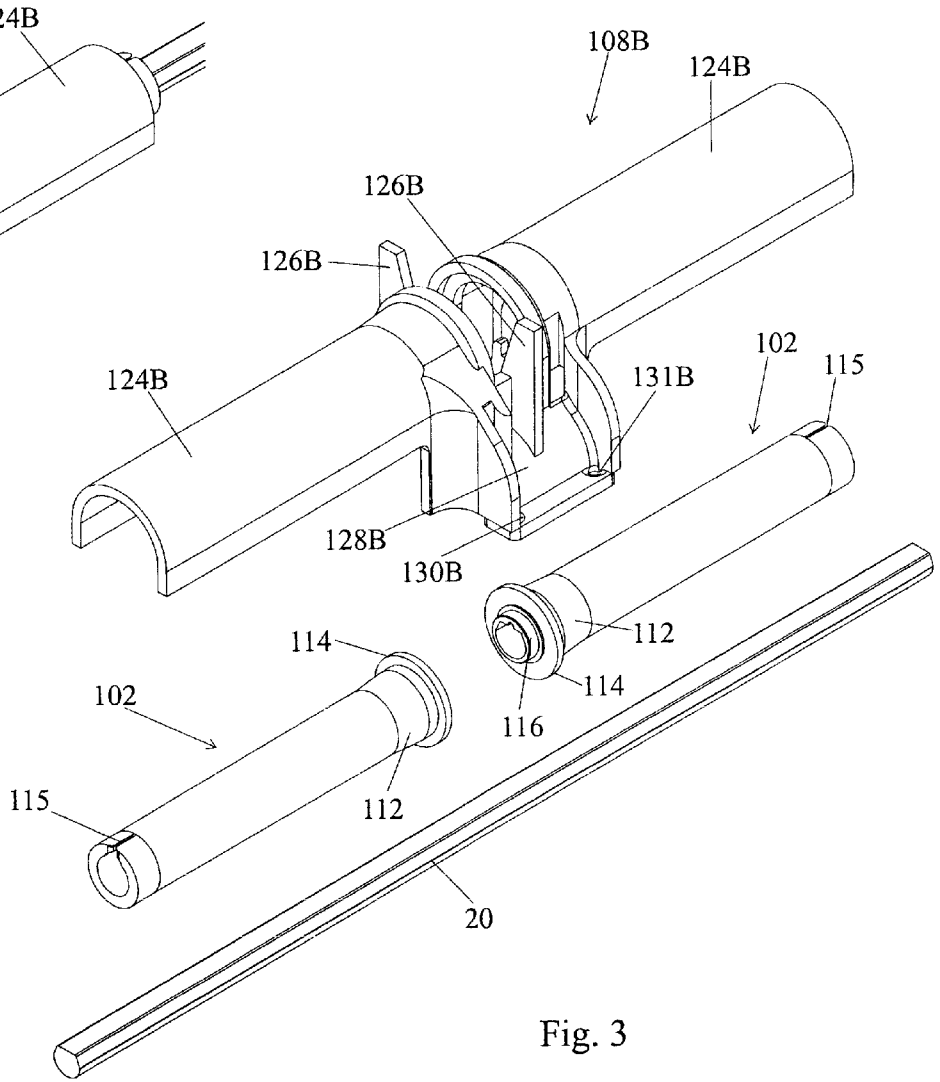
FIG. 3 is an exploded perspective view of the cord drive of FIG. 2.
Figure 2:
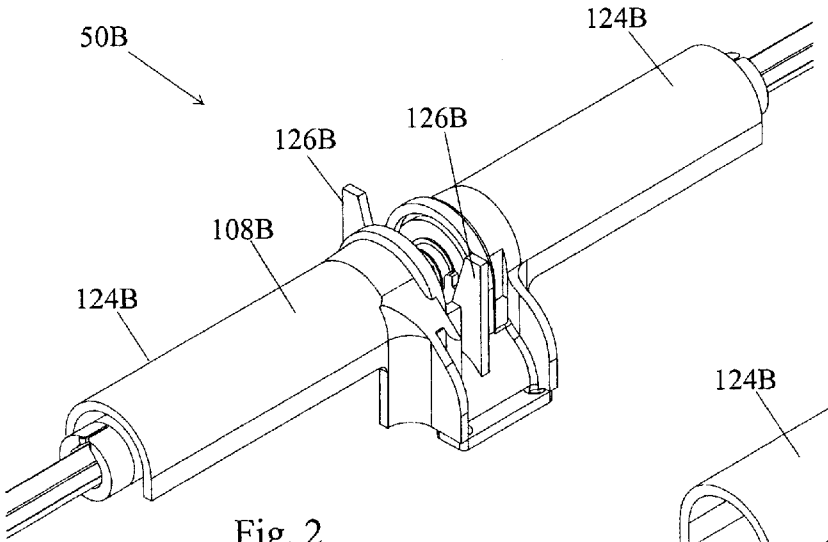
FIG. 2 is a perspective view of the cord drive of FIG. 1.
Figure 3A:
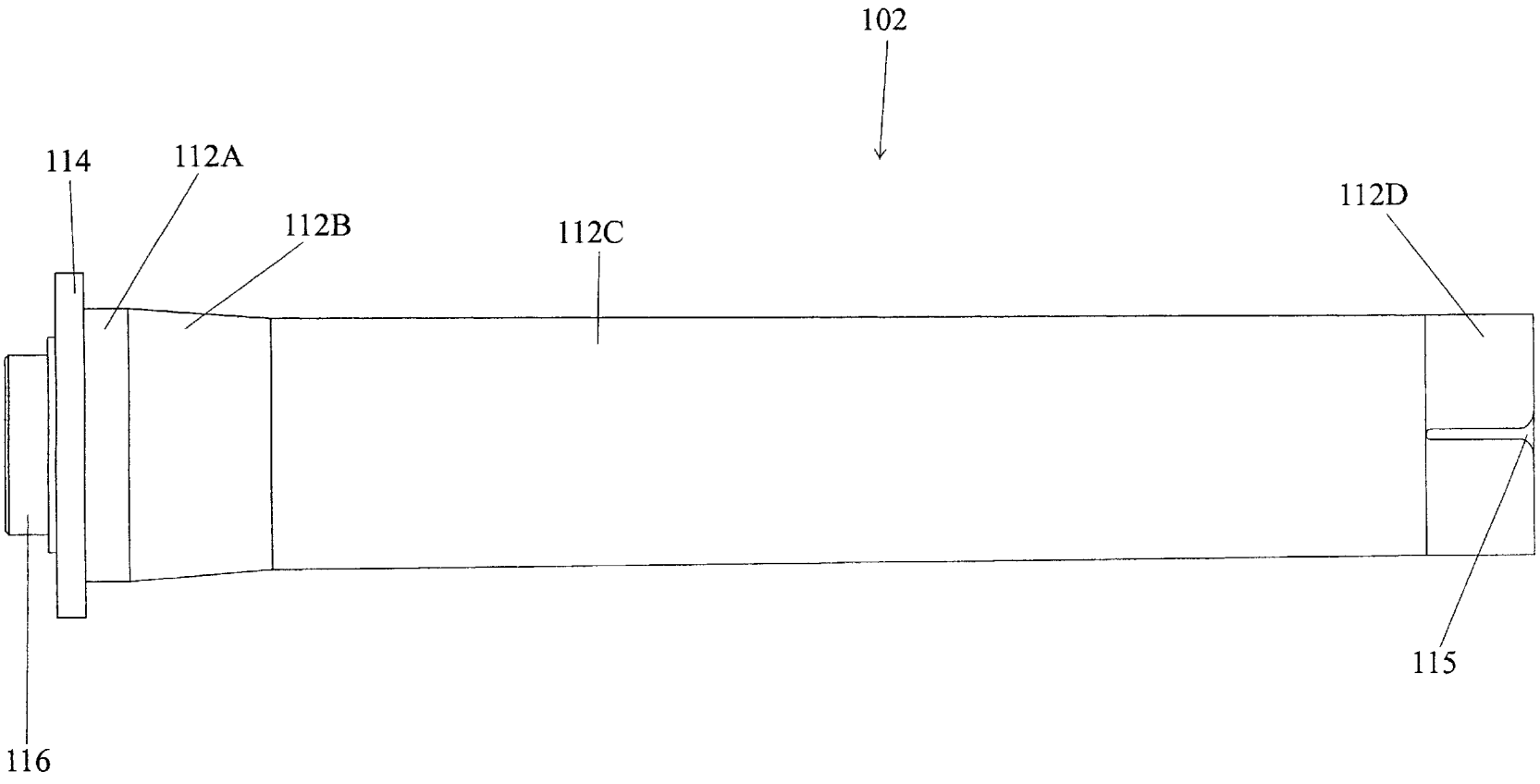
FIG. 3A is an enlarged side view of one of the spools of FIG. 3.

FIGS. 2 and 3 depict a second embodiment of a cord drive 50B. The cover 108B is a combination of the covers from the first and fourth embodiments described earlier. The longer hoods 124B are present but without any hooks. Instead, ears 126B are used, similar to those in the fourth embodiment 54. The foot 128B is also essentially identical to the foot 128 of the fourth embodiment 54. Once again, this cord drive 50B operates in the same manner as the cord drive of FIGS. 8–14.

Figures 4, 5:
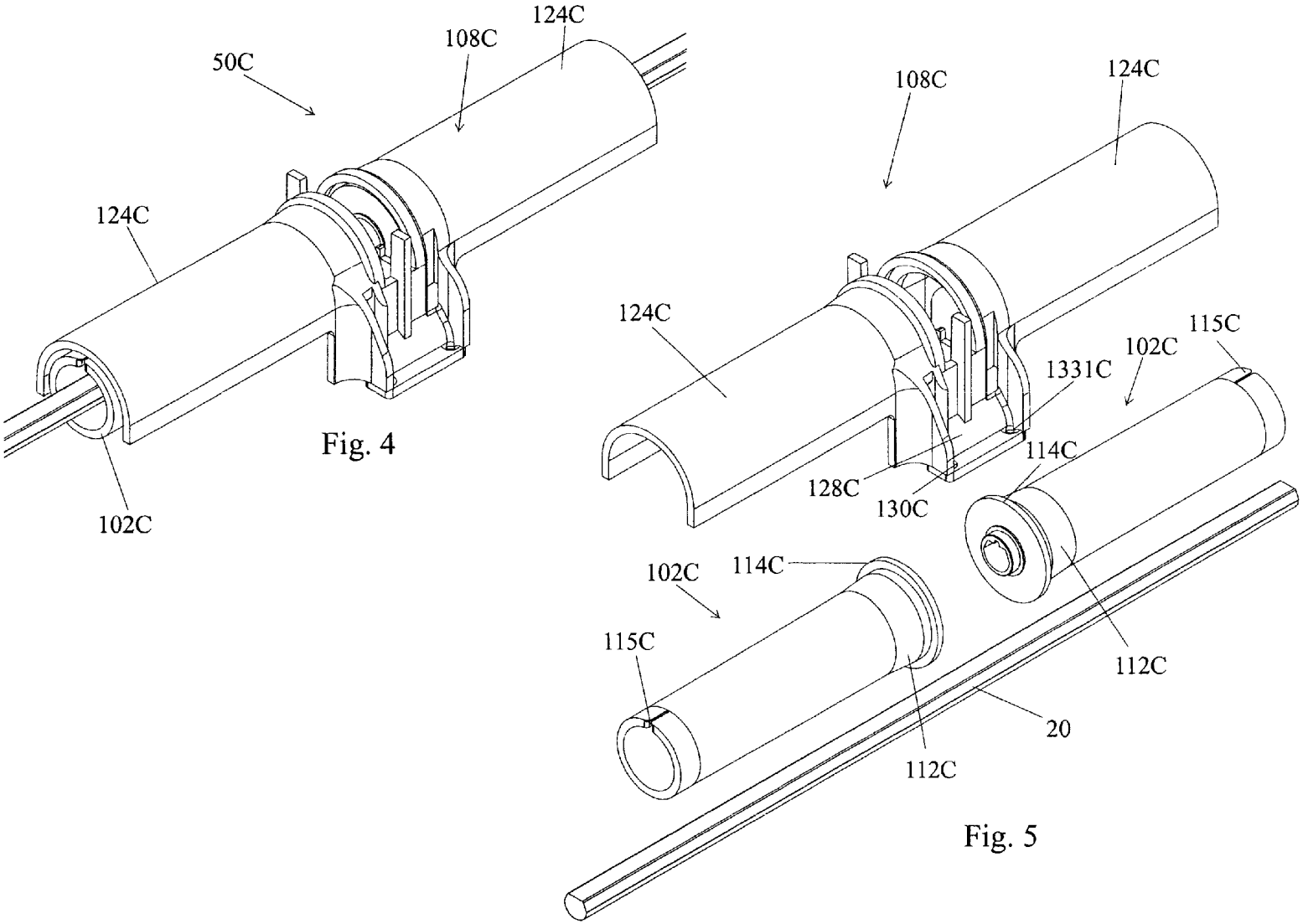
FIG. 4 is a perspective view of a second embodiment of a cord drive made in accordance with the present invention.
FIG. 5 is an exploded perspective view of the cord drive of FIG. 4.

FIGS. 4 and 5 depict a third embodiment of a cord drive 50C. The cover 108C is essentially identical to that of the second embodiment 50B, except that the hoods 124C have a larger radius in order to accommodate the larger diameter spools 102C. These larger diameter spools 102C are the significant difference of this embodiment 50C from those described earlier. The larger the effective diameter of the outer surface 112C of the spool 102C, the less mechanical force is required to raise or lower the stack of blinds, but the more travel is required of the drive cords 106. For instance, if the diameter of the spool 102C is the same as the diameter of the lift spool on the lift module 60, the force required to raise or lower the blinds is relatively small, but the drive cords 106 must travel the same distance as the blinds. That is, for every foot of rise (or fall) of the bottom head rail 14A, each of the drive cords 106 must also travel one foot. On the other hand, if the diameter of the spool 102C is one half the diameter of the lift spool on the lift module 60, the force required to raise or lower the blinds will be twice as large as in the previous case, but the drive cords 106 will now travel only half the distance traveled by the blinds. That is, for every foot of rise (or fall) of the bottom head rail 14A, each of the drive cords 106 must travel only half a foot. The fact that twice the motive force is required is not a serious drawback, especially in a counterbalanced transport system as described in U.S. patent application Ser. No. 09/528951, filed Mar. 20, 2000. In this instance, the system is in balance and only a small catalytic force is required to offset the balance and overcome the system inertia so as to raise or lower the blinds.

FIGS. 15 through 23 depict additional embodiments of cord drives made in accordance with the present invention. These are depicted in a schematic form with some of the elements, such as the cover and in some instances also the drive cords, omitted for ease of showing the operating mechanism.

Figure 17:
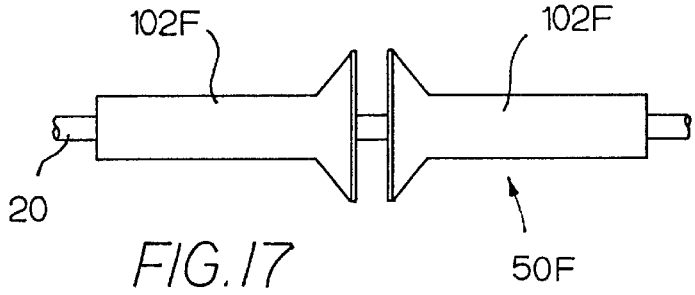
FIG. 17 is a schematic top view of a sixth embodiment of a cord drive made in accordance with the present invention, again with the cover removed.

FIG. 17 depicts a cord drive 50F which is representative of the embodiments described thus far, namely two independent tapered spools 102F connected by a lift rod 20. The two separate spools 102F allow a space in between them to install a support structure at the point where the downward forces are applied to the spools 102F by the action of pulling on the drive cords 106. As with the first through fourth embodiments, in this case the two spools 102F rotate together by being non-rotatably mounted on the same drive shaft or lift rod 20. Thus FIG. 17 schematically depicts any of the embodiments already described.

As shown in FIGS. 15 and 16, the two spools 102E may be placed abutting each other, and in fact may actually be a single piece, which would make the spool piece stronger and may thus eliminate the need for a support structure. In this case, the two spools 102E may be a unitary piece either by being formed as a single member or by being made of a plurality of members that are adhered, riveted, bolted, snapped together, or otherwise secured together to function as a unitary piece. The combination of a strong unitary spool 102E and the lift rod 20 may provide enough support that a separate supporting structure becomes unnecessary. The operating principle remains the same as that of previously described embodiments, with one drive cord wrapping onto its spool while the other cord unwraps.

Figure 18:
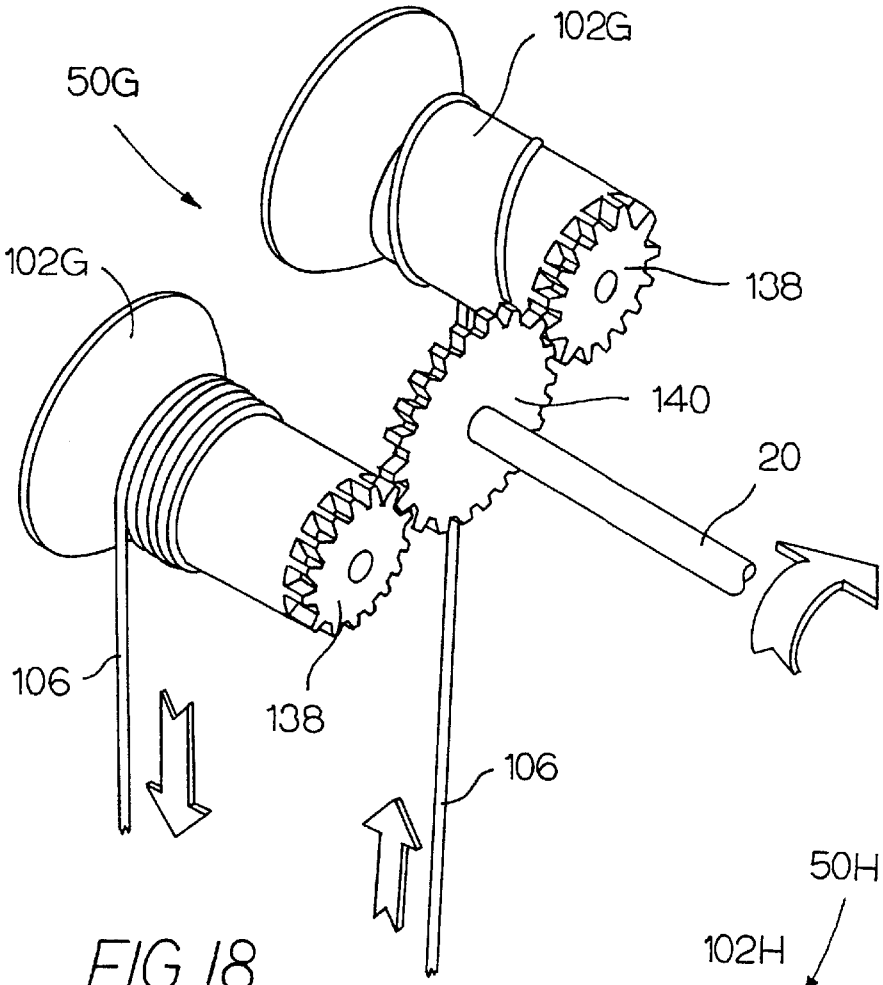
FIG. 18 is a schematic, broken away, perspective view of a seventh embodiment of a cord drive made in accordance with the present invention, where the cover has been removed for clarity.
Figure 19:
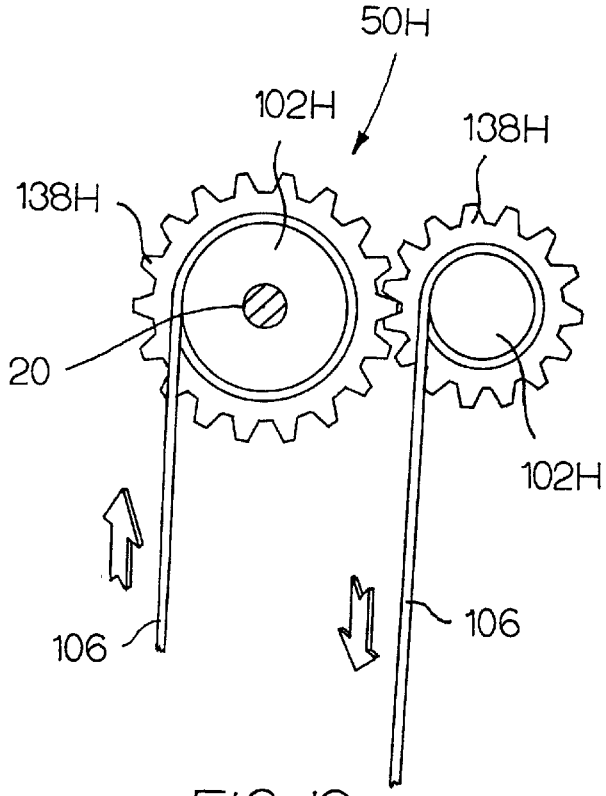
FIG. 19 is a schematic end view of an eighth embodiment of a cord drive made in accordance with the present invention, where the cover has been removed for clarity.

FIGS. 18 and 19 show seventh and eighth embodiments, both of which use gears to cause the spools to rotate together. One advantage of these embodiments is that the drive cords 106 may now be made to exit at an end of the head rail 12, instead of exiting to one side (front or rear) of the head rail 12.

The seventh embodiment 50G, shown in FIG. 18, has two parallel tapered spools 102G which end in gears 138. The lift rod or drive shaft 20, which is parallel to the spools 102G, also has a gear 140 at one end, and this gear 140 is meshed with both spool gears 138, causing the spools 102G to rotate together in the same direction. Thus, when one of the drive cords 106 is pulled so as to unwind from its spool 102G, its associated gear 138 will rotate, thereby driving the lift rod gear 140 and the lift rod 20, which also rotates and drives the lift spool of the lift module 60 so as to raise or lower the blinds. The lift rod gear 140 is also meshed with the spool gear 138 of the other spool 102G, and thus the rotation of the lift rod gear 140 also drives the second spool gear 138, causing the second spool gear 138 to rotate in the same direction as the first spool gear 138. Since the drive cords 106 are wrapped onto their corresponding spools 102G in opposite directions, as both spools 102G rotate in the same direction, one drive cord will be unwinding while the drive cord will be winding onto its spool. The lift rod gear 140 may be of a different size than that of the spool gears 138. If the lift rod gear 140 is larger in diameter than the spool gears 138, then the mechanical advantage will be greater, but the drive cords 106 will have to travel a longer distance than the vertical distance traveled by the blind. On the other hand, a smaller lift rod gear 140 (relative to the spool gears 138) will have less mechanical advantage, but a shorter distance of travel by the drive cords 106 will result in a longer vertical distance traveled by the blind. Thus, by varying the relative effective diameters of the spool gears 138 relative to the lift rod gear 140, the same effect may be achieved as by varying the effective wrap diameter of the spools relative to the lift spool on the lift module 60.

The eighth embodiment 50H, shown in FIG. 19, is similar to the seventh embodiment previously described. The spools 102H once again are identical and, as in the previous embodiment 50G, they end in gears 138H. However, in this embodiment, the lift rod gear is eliminated, the lift rod 20 is connected directly to the center of one of the geared spools 102H, and the two spool gears 138H are meshed with each other, causing the spools 102H to rotate together in opposite directions. One significant difference of this embodiment 50H from that of all other embodiments described thus far is that the drive cords 106 are NOT wrapped in opposite directions. Instead, they are both wrapped in the same direction onto their respective spools, because the spools rotate in opposite directions. The gear action reverses the direction of rotation of the spools 102H such that, when one cord 106 is being pulled to unwind from, and rotate, its corresponding spool 102H, the second drive cord 106 is wrapping onto its corresponding spool 102H. Except for this difference, the principle of operation of this embodiment 50H is identical to that of the previously described embodiment 50G. One advantage of this embodiment 50H over that of the previous embodiment 50G is that it requires less width to fit in the head rail 12.

Figure 20:
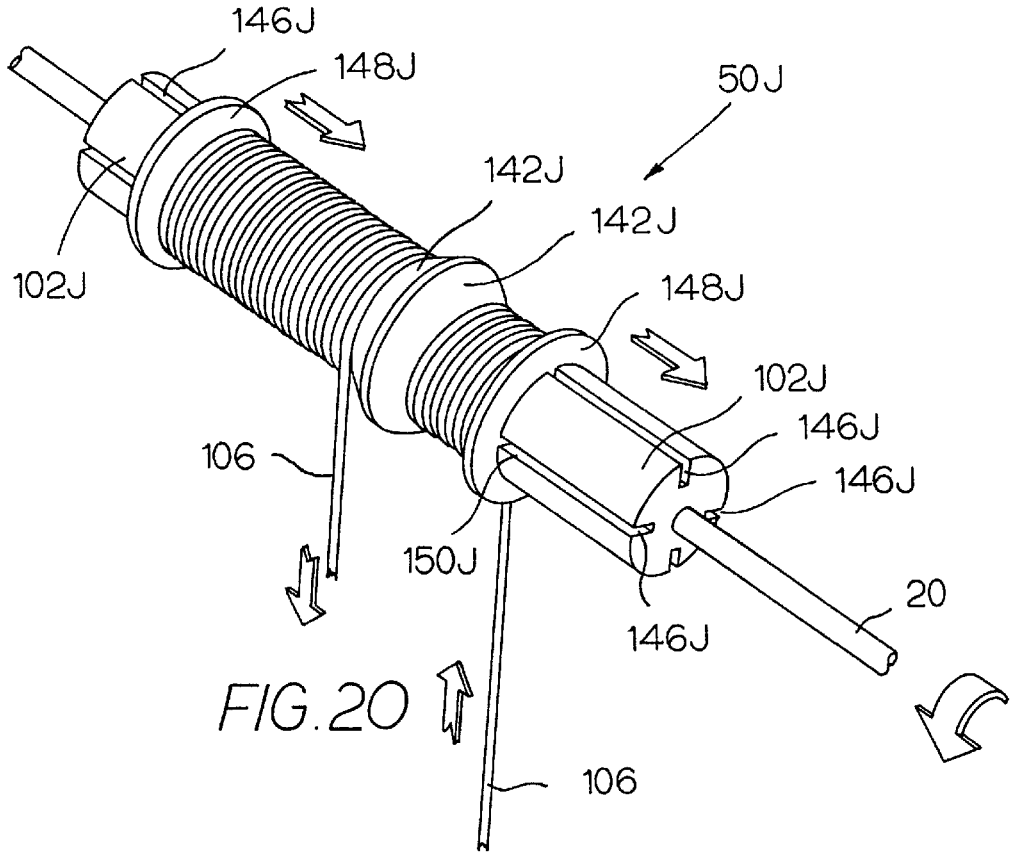
FIG. 20 is a schematic, broken away, perspective view of a ninth embodiment of a cord drive made in accordance with the present invention, where the cover has been removed for clarity.

FIG. 20 depicts a ninth embodiment of a cord drive 50J in accordance with the present invention. This embodiment 50J is very similar to the fifth embodiment 50E shown in FIGS. 15 and 16. It should be noted that any of the spools 102 previously described may be tapered along their entire length, or they may be tapered only for a short length, in the area where the cover places the drive cord 106 onto the spool. The remainder of the length of the spools may be non-tapered.

FIG. 20 depicts two spools 102J (which may be formed as a unitary piece as has already been described), each spool 102J having a short tapered inlet section 142J adjacent to a non-tapered storage section. The storage section of each spool defines one or more key-ways 146J which run longitudinally, parallel to the axis of the spool 102J. Two anchoring disks 148J, having an inside diameter just slightly larger than the outside, non-tapered diameter of the storage sections of the spools 102J, have internal projections 150J which fit into the key-ways 146J. The disks 148J freely slide axially along the storage sections of their respective spools 102J but must rotate with the spools 102J and the drive shafts 20, because the projections 150J of the anchoring disks 148J engage the key-ways 146J of the spools 102.

One end of each drive cord 106 is secured to its respective spool by being secured to a sliding anchoring disk 148J, instead of being secured directly to the end of the spool as has been described for the previous embodiments. The rest of the installation and operation is identical to that described for the fourth embodiment 54. However, one may notice in FIG. 20 that the successive wraps of drive cord 106 on the spools 102J are tight one against the other, as opposed to the successive wraps of cord 106 on the previous embodiments, as shown in FIGS. 15 and 16, where there is a gap between adjacent wraps, and this gap becomes more pronounced as there are fewer wraps remaining on the spool 102E. In this latest embodiment of a cord drive 50J, as the drive cord 106 is wound onto the spool 102J, the cord wraps push against the disk 148J which then slides axially away from the tapered section of the spool 102J. As the drive cord is unwound from the spool 102J, the disk is pulled axially by the cord 106, toward the tapered inlet section of the spool 102J. This has two positive effects on the design and performance of the cord drive 50J:

First, the length of the spool 102J may be cut in half from that of an equivalent cord drive of the non-sliding disk design, because there are no gaps in successive wraps of the drive cord 106. The wraps of drive cord are always tight, one wrap against the next.

Second, the unwinding force remains constant throughout the entire run-out of the cord. In a non-sliding disk design (such as that depicted in FIG. 15), the initial angle of the wound-up drive cord 106 is 90° (perpendicular to the axis of rotation of the spool). With successive revolutions of the spool, as the drive cord unwinds, the angle approaches closer to the axial direction of the spool. This causes the force required to continue the unwinding process to increase with each successive revolution as an increasingly larger part of the force is wasted pulling horizontally against an unyielding point (where the drive cord is attached directly to the spool). In the sliding disk embodiment 50J, the disk is continually moved axially so that the drive cord 106 is always perpendicular to the axis of rotation of the spool 102J. Thus, the unwinding force remains constant, and at a minimum, throughout the entire range of the drive cord 106.

Figure 21:
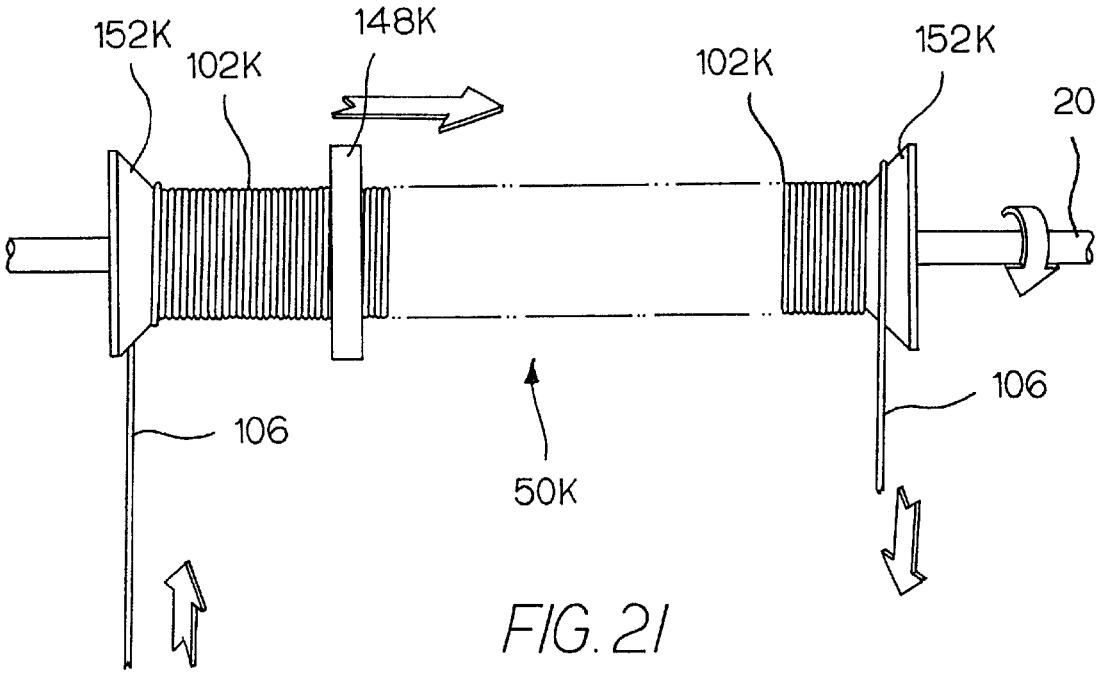
FIG. 21 is a schematic front view of a tenth embodiment of a cord drive made in accordance with the present invention.

FIG. 21 shows a tenth embodiment of a cord drive 50K made in accordance with the present invention. This embodiment is very similar in concept to the ninth embodiment 50J described earlier, except that, in this embodiment, the storage portions of the spools are adjacent to each other, the inlet portions 152K are at the outer ends of the spools 102K, and a single sliding disk 148K anchors the ends of both cords 106. (Note that, in order to mount the disk 148 K onto the spool 102K, one of the pieces, either the disk 148K or the spool 102K, should be made in at least two parts).

The drive cords 106 are counter-wrapped onto the spools 102K, and the ends of the drive cords 106 are secured to the common disk 148K. As one drive cord 106 is pulled to unwind from its spool 102K, the other drive cord 106 will automatically wrap onto its spool 102K and at the same time push the disk 148K axially so that there are not any gaps on successive wraps of the drive cord 106, whether winding or unwinding. The exit point of the drive cords 106 is still fixed relative to the head rail 12, as is the case for all previous embodiments described thus far; they are just a little further apart from each other than they have been in previous embodiments.

While several embodiments of the present invention have been described above, it is not possible or required to show every conceivable embodiment of the invention in order for all the possible embodiments to be covered by the claims of this patent application. Therefore, it will be obvious to those skilled in the art that modifications may be made to the embodiments described above without departing from the scope of the present invention.

What is claimed is:

1. A cord drive, comprising:

first and second spools, each of said spools being tapered from a larger diameter inlet portion to a smaller diameter storage portion;

means for causing said first and second spools to rotate together; and first and second cords mounted on said first and second spools, respectively, wherein pulling said first cord causes said first cord to unwrap from said first spool and said second cord to wrap onto said second spool, and pulling said second cord causes said second cord to unwrap from said second spool and said first cord to wrap onto said first spool.

2. A cord drive as recited in claim 1, wherein said inlet portion has a substantial taper and said storage portion has little or no taper.

3. A cord drive as recited in claim 1, wherein said cords define a diameter, and further comprising a cover mounted over at least one of said spools and one of said cords, said cover defining a gap between the cover and its respective spool of less than two of said cord diameters to prevent overwrapping of said one cord.

4. A cord drive as recited in claim 1, wherein said cords have ends fixed to their respective spools.

5. A cord drive as recited in claim 1, wherein said means for causing said first and second spools to rotate together includes said first and second spools being a unitary piece.

6. A cord drive as recited in claim 1, and further comprising a first anchoring member mounted on said first spool, said anchoring member being keyed to said first spool so that said anchoring member is axially movable but not rotatable relative to said first spool, and wherein said first cord has an end secured to said anchoring member.

7. A cord drive as recited in claim 6, wherein said first and second spools are coaxial and said second cord has an end that is also secured to said anchoring member.

8. A cord drive as recited in claim 6, and further comprising a second anchoring member keyed to said second spool so that said second anchoring member is axially movable but not rotatable relative to said second spool, and wherein said second cord has an end secured to said second anchoring member.

9. A cord drive as recited in claim 1, wherein said first and second spools are coaxial.

10. A cord drive as recited in claim 9, wherein said inlet portions of said first and second spools lie adjacent to each other.

11. A cord drive as recited in claim 9, wherein said storage portions of said first and second spools lie adjacent to each other.

12. A cord drive as recited in claim 1, and further comprising a drive shaft, wherein said means for causing said first and second spools to rotate together includes said first and second spools being non-rotatably mounted on said drive shaft for rotation with said drive shaft.

13. A cord drive as recited in claim 1, wherein said means for causing said first and second spools to rotate together includes a plurality of meshed gears.

14. A cord drive as recited in claim 13, wherein said first and second spools rotate together in the same direction.

15. A cord drive as recited in claim 13, wherein said first and second spools rotate together in opposite directions.

16. A cord drive as recited in claim 1, and further comprising a drive shaft driven by said first and second spools.

17. A cord drive as recited in claim 16, and further comprising a lifting spool driven by said drive shaft, and a lift cord having first and second ends, the first end of said lift cord being mounted on said lifting spool.

18. A cord drive as recited in claim 17, wherein said cord drive is mounted on a covering for architectural openings including a bottom rail, and wherein the second end of said lift cord is secured to said bottom rail.

19. A cord drive as recited in claim 1, wherein each of said spools has an axis of rotation, and further comprising housings mounted over said first and second spools and fixed in the axial direction relative to said spools, said housings having inner surfaces which define guide paths for guiding the cords onto the inlet portions of said first and second spools.

20. A cord drive as recited in claim 19, wherein said spools have the same axis of rotation, said housings are secured together to ensure that the guide paths are fixed relative to each other, and said guide paths guide the cords to wrap in opposite directions onto said first and second spools.

21. A cord drive as recited in claim 20, wherein said housings are made as a single piece.

22. A cord drive as recited in claim 21, wherein said cords define a diameter, and wherein said housings define gaps between the housings and their spools of less than two of said cord diameters to prevent overwrap.

23. A cord drive as recited in claim 10, wherein there is a bearing surface between, and of a smaller diameter than, the inlet portions of the spools for supporting the spools.

24. A cord drive as recited in claim 19, wherein at least one of said housings further defines a substantially axially-oriented, convex curve on its inner surface, which guides the cord over a large radius as it is unwrapping from distant portions of the spool in order to minimize friction.

25. A cord drive, comprising:

first and second coaxial spools, each of said spools including a large diameter, substantially tapered inlet portion and a smaller diameter storage portion adjacent to its respective inlet portion, wherein each inlet portion tapers down toward its respective smaller diameter storage portion, said inlet portions lying adjacent to each other and being tapered in opposite directions; and first and second cords secured to said first and second coaxial spools, respectively;

said first and second spools being mounted so as to rotate together, and said cords being wrapped onto their respective spools, such that, pulling said first cord causes said first cord to unwrap from said first spool and said second cord to wrap onto said second spool, and pulling said second cord causes said second cord to unwrap from said second spool and said first cord to wrap onto said first spool.

26. A cord drive as recited in claim 25, wherein each of said first and second spools defines a slit distant from its inlet portion, each of said cords has a cord end, and each of said slits receives its respective cord end, thereby securing the respective cord end to the respective spool.

27. A cord drive as recited in claim 25, and further comprising first and second axially slidable anchoring members mounted on said first and second spools, respectively, said first and second axially slidable anchoring members being keyed to their respective spools, wherein said first and second cords are secured to said first and second anchoring members, respectively.

28. A covering for architectural openings, including:

a head rail;

a covering suspended from said head rail and including a bottom rail;

a lift cord suspended from said head rail and secured to said bottom rail;

a lift spool rotatably mounted in said head rail, said lift cord mounted on said lift spool for raising and lowering said covering;

a drive shaft which drives said lift spool;

first and second drive spools mounted so as to rotate together and to drive said drive shaft, each of said first and second drive spools defining an inlet portion and a storage portion adjacent to the inlet portion, wherein the inlet portion has a large diameter at one end and tapers down toward the smaller diameter storage portion;

first and second drive cords mounted on said first and second drive spools, wherein pulling said first drive cord causes said first drive cord to unwrap from said first spool and said second drive cord to wrap onto said second spool, causing said first and second spools to rotate said drive shaft and said lift spool in a first direction to wrap said lift cord onto said lift spool, raising said bottom rail and said covering, and, wherein, pulling said second cord causes said second cord to unwrap from said second spool and said first cord to wrap onto said first spool, causing said first and second spools to rotate said drive shaft and said lift spool in an opposite direction to unwrap said lift cord from said lift spool, lowering said bottom rail and said covering.

29. A covering for architectural openings as recited in claim 28, wherein said first and second spools are a unitary piece.

30. A covering for architectural openings as recited in claim 28, wherein said first and second spools are non-rotatably mounted on said drive shaft.

31. A covering for architectural openings as recited in claim 28, and further comprising a plurality of meshed gears mounted so as to cause said first and second spools to rotate together.

32. A covering for architectural openings as recited in claim 28, wherein said first and second spools are mounted so as to rotate together in the same direction.

33. A covering for architectural openings as recited in claim 28, wherein said first and second spools are mounted so as to rotate together in opposite directions.

34. A covering for architectural openings as recited in claim 28, wherein said first and second spools are coaxial and said inlet portions of said spools lie adjacent to each other.

35. A covering for architectural openings as recited in claim 28, wherein said first and second spools are coaxial and said storage portions of said spools lie adjacent to each other.

36. A covering for architectural openings as recited in claim 28, wherein said first and second drive cords are mounted in slits in said first and second spools, respectively.

37. A covering for architectural openings as recited in claim 28, and further comprising a first axially slidable, anchoring member non-rotatably mounted on said first spool, wherein said first cord is mounted on said first anchoring member.

38. A covering for architectural openings as recited in claim 37, wherein the first and second spools are coaxial, and the storage portions of the spools lie adjacent to each other, and both said first and second cords are mounted on said first anchoring member.

39. A covering for architectural openings as recited in claim 37, and further comprising a second axially slidable anchoring member non-rotatably mounted on said second spool, wherein said second cord is mounted on said second anchoring member.

40. A cord drive, comprising:

first and second spools mounted so as to rotate together;

first and second cords mounted on said first and second spools such that pulling said first cord causes said first cord to unwrap from said first spool and said second cord to wrap onto said second spool, and pulling said second cord causes said second cord to unwrap from said second spool and said first cord to wrap onto said first spool; and a first axially slidable anchoring member non-rotatably mounted on said first spool, wherein the first cord is mounted on said first anchoring member.

41. A cord drive as recited in claim 40, and further comprising a second axially slidable anchoring member non-rotatably mounted on said second spool, wherein the second cord is mounted on said second anchoring member.

42. A cord drive as recited in claim 40, wherein said second cord is also mounted on said first anchoring member.

* * * * *